United States Patent [19]

McClure

[11] Patent Number: 4,559,805

[45] Date of Patent: Dec. 24, 1985

[54] HAND SEAMER

[75] Inventor: Richard R. McClure, Basehor, Kans.

[73] Assignee: Butler Manufacturing Company, Kansas City, Mo.

[21] Appl. No.: 655,623

[22] Filed: Sep. 28, 1984

[51] Int. Cl.[4] ..... B21D 17/02

[52] U.S. Cl. ..... 72/384; 72/409; 72/387; 72/479; 29/243.5; 81/307; 81/310

[58] Field of Search ..... 72/384, 387, 409, 479, 72/458; 29/243.5, 243.58, 283.5; 81/303, 304, 307, 308, 310

[56] References Cited

U.S. PATENT DOCUMENTS

| | | | |
|---|---|---|---|
| 478,723 | 7/1892 | Totten . | |
| 498,718 | 5/1893 | King . | |
| 1,692,954 | 4/1929 | Roughan . | |
| 2,002,502 | 5/1935 | Douglas | 72/409 |
| 2,119,032 | 5/1938 | Wobbe . | |
| 2,159,784 | 5/1939 | Demmin . | |
| 2,172,351 | 9/1939 | Kivley et al. | 72/409 |
| 2,436,278 | 2/1948 | Willett . | |
| 2,732,744 | 1/1956 | Kuchman et al. . | |
| 4,072,118 | 2/1978 | Schultheiss . | |

FOREIGN PATENT DOCUMENTS

| | | | |
|---|---|---|---|
| 1313955 | 11/1962 | France | 72/409 |

*Primary Examiner*—Francis S. Husar
*Assistant Examiner*—David B. Jones
*Attorney, Agent, or Firm*—Shoemaker and Mattare, Ltd.

[57] ABSTRACT

A hand seaming tool for use during original installation or re-roofing of roof panels of a building. A pair of main body elements, a pair of interconnected intermediate body elements, handle structure, limit structure, and an anvil head and forming bar all cooperate to permit an operator and user of the device to perform double seaming of the edge flanges of adjacent roof panels. Preferably, such operation occurs during initial starting of the double seaming and/or the final completion of such double seaming operation. A motorized roof seamer is normally used for the intermediate portion between the beginning and ending double seamed areas.

17 Claims, 12 Drawing Figures

52
40
B
32
64
HF 1
HF 2
A 137
138
RP
X
HF 1
FL 1
HF 2
FL 2
RP

HAND SEAMER

BACKGROUND OF THE INVENTION

1. Field of the Invention

This invention relates generally to apparatus for seaming the edges of roof panels together during initial construction of a building roof.

2. Description of the Prior Art

A common problem with seaming devices for roof construction is that obstructions near the beginning of such seam, and/or at the end of such seam, can prevent the effective operation of a conventional type seaming machine. However, in order for the roof to be water-tight and completely finished, it is absolutely necessary that the seams be completed for the entire length of the respective roof panels.

Another common problem of known type seaming devices is that they fail to properly form a double seam type construction as is necessary with assignee's MR-24 type roof.

Existing prior patents which may be pertinent to this invention are as follows:

U.S. Pat. No. 478,723—7/12/92—Totten
U.S. Pat. No. 498,718—5/30/93—King
U.S. Pat. No. 1,692,954—4/30/27—Roughan
U.S. Pat. No. 2,119,032—5/31/38—Wobbe
U.S. Pat. No. 2,159,784—5/23/39—Demmin
U.S. Pat. No. 2,436,278—2/17/48—Willett
U.S. Pat. No. 2,732,744—1/31/56—Kuchman et al.
U.S. Pat. No. 4,072,118—2/ 7/78—Schultheiss None of these patents disclose a tool for double seaming flanges between roof panels at the very start or very end of the seaming of same for either new construction and/or the re-roofing market.

The King U.S. Pat. No. 498,718 and the Totten U.S. Pat. No. 478,723 both show devices for folding and making seams with metal panels. However, neither device is usable with the double seaming required at the beginning or ending of seaming of roof panels.

U.S. Pat. No. 1,692,954 to Roughan shows a tool for applying clamps to a pair of bars, while Wobbe U.S. Pat. No. 2,119,032 shows apparatus for bending the edges of a metal plate. Demmin U.S. Pat. No. 2,159,784 shows a tool for forming Pittsburgh joints between metal sheets.

Willett U.S. Pat. No. 2,436,278 and Kuchman et al. U.S. Pat. No. 2,732,744 both show tools for holding and bending the edges of metal sheets.

Schultheiss U.S. Pat. No. 4,072,118 shows an apparatus for crimping seams of metal panels. However, it is not for the purpose of making seams at the very start or very end of such panels where an abutment or obstruction is present.

None of the known prior art devices offer the new and novel features of the present invention.

SUMMARY OF THE INVENTION

An object of the present invention is to provide a hand seamer for use in making double seam connections between adjacent metal roof panels at the very beginning or end of such seams. Oftentimes, obstructions and the like exist at the very beginning or ending of the roof panel seams, and in such cases conventional type seaming apparatus cannot effectively be used.

Another object of this invention is to provide a relatively fast and easy, and yet very efficient and accurate, hand seaming tool for use in forming double seams for the 18" to 24" length at the beginning or at the end of roof panel construction.

A further object of this invention is to provide an uncomplicated, fairly inexpensive tool for quickly and yet accurately forming double seams at the beginning and end of roof panel construction, and especially where such ends are adjacent obstructions.

A still further object of this invention is to provide a seaming tool which can be used by hand for forming a complete double seam in a minimum number of steps for initial and finalization of roof construction seams where a motor driven seamer is used for forming the main portions of the double seam.

The present invention is for a hand tool which has a pair of anvil heads in plier-type actuating and clamping frame with handle members for actuating the mechanism to open and close the anvil heads. Suitable actuation of the heads will form the initial seam between two adjacent flanges of roof panels. Then, by actuating a brake lever, a forming bar can be suitably rotated to bend the first seam through approximately 120° to form the initial start of the double seam. Then again, the anvil heads can be clamped together for completing the double seaming of the panel edges.

This tool is especially useful for the initial 18" of roof panel installation with assignee's panels specifically designated as type MR-24. It has been discovered in actual practice that such roof panels, when being installed adjacent an obstruction, and especially during re-roofing operations where additional buildings or other type obstructions are closely adjacent one end of the roof edge, or in some cases both ends, it is almost impossible to use assignee's motor operated roof seamer. In such cases, it is imperative that some way of seaming the initial or final 18" of the roof seam be made possible. The present invention very effectively accomplishes this purpose.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 2A is a perspective view of the hand seamer of the present invention, while

DESCRIPTION OF THE PREFERRED EMBODIMENT(S)

Figure 1:
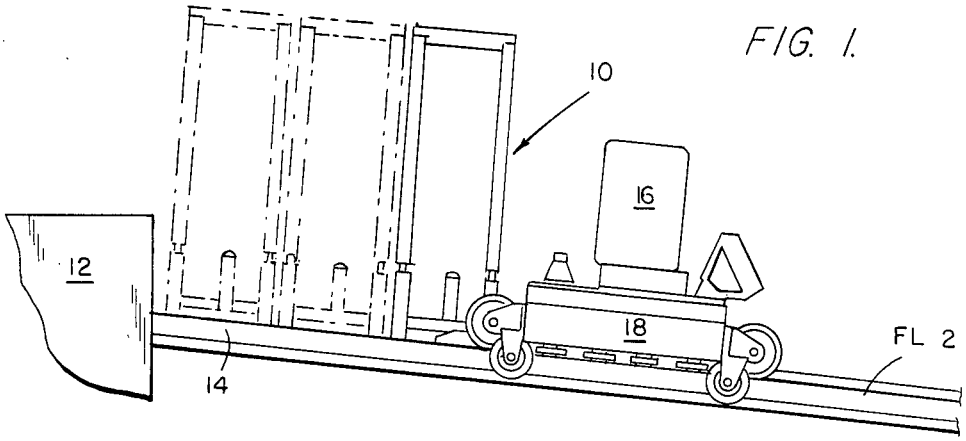
FIG. 1 is a schematic showing of a roof panel with assignee's motorized roof seamer together with the tool of the present invention.

Looking at FIG. 1 of the drawings, reference numeral 10 indiates in general the hand seamer of the present invention. As shown, an abutment or obstruction 12 exists at the upslope edge of a roof. A roof panel 14 is shown having a flange FL2 abutting the flange FL1 (FIG. 5) of the next adjacent panel. A ROOF RUNNER seamer, which is a proprietary item of the assignee of the present application, is shown having a motor 16 and actuating cam and base structure 18. This ROOF RUNNER, as described in assignee's previous patents, generally and normally is used to double seam the roof panel flanges. However, in actual practice oftentimes an obstruction, such as indicated at 12 at the left of FIG. 1, is present at either the beginning or ending of the double seam. In FIG. 1, as shown, the obstruction is present at the upslope end of the seaming operation. With such a typical obstruction, the hand seamer of the present invention is especially useful.

Looking at FIGS. 2A, 2B, 3 and 4, the basic construction of the hand seamer of the present invention will now be described in detail. A double pair of body elements 20 and 30 normally are pivotally engaged by the interleaved projections 22 and 32 from the respective elements. A pin 123 normally connects each of the respective pairs of body elements together so that they can pivot with respect to each other. Lock rings 223 keep the pin in place once mounted. The upper portions of the respective body elements connect with double pairs of actuating members 28 and 38, respectively, through suitable interconnected projections with apertures AP and pins 123. The respective body elements 28 and actuating members 38 also interconnect with each other through suitable projections with apertures AP and pins 123. Of course, additional lock rings 223 keep the latter pins in place.

The lower ends of the double pair of body elements are provided with anvil and forming bars. The body elements 20 have supported therebetween a support block 47 for a forming bar 42 which is best seen in FIG. 7, each end of which has a semi-circular projection 142 which rides in a semi-circular recess 120 provided in the inner face of each body element 20.

The pair of body elements 30 have a longitudinally extending cross member anvil head 32. This anvil head 32 has a flange lip engaging face 132 and a tapered channel recess 34 with sloping shoulders 35 in the upper surface thereof.

Figure 8:
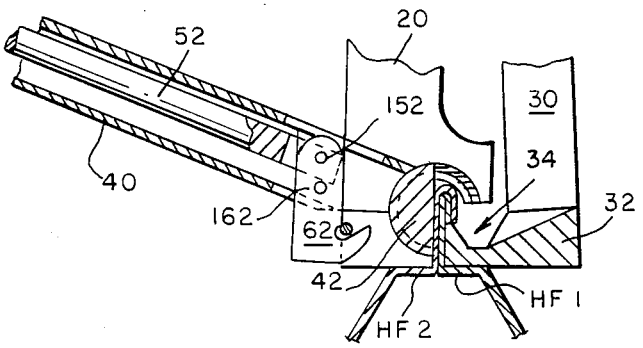
FIGS. 8, 9 and 10 show various phases of step 2 of the seaming operation.
Figure 9:
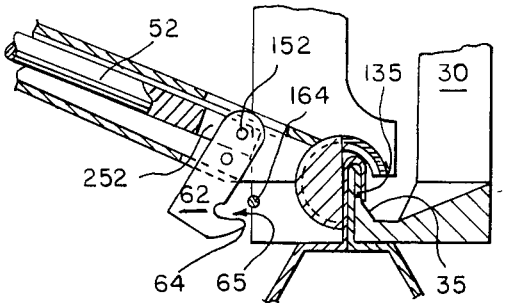
Figure 10:
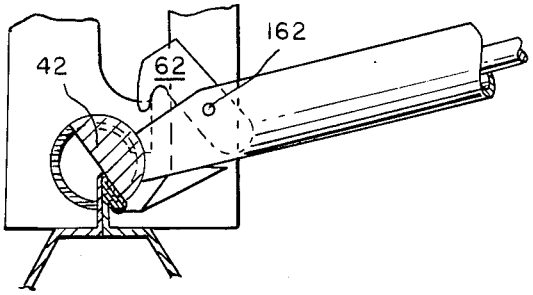

The forming bar 42 is provided with an actuating tube 40 attached near the mid-portion thereof. The actuating tube 40 is provided longitudinally therethrough with a brake release rod 52. The rod 52 has an enlarged head portion 50 with a spring 54 normally biasing the release bar in the outward, brake engaging position. As best seen in FIGS. 8–10, a latch plate 62 is pivotally mounted by pin 152 to the brake rod 52. A slot 252 at the inner end of brake rod 52 receives the latch plate 62 therebetween. Also, the latch plate 62 is pivotally mounted by pin 162 from the actuating tube 40. Thus, as can be easily visualized and as depicted in FIGS. 8–10, upon actuation of the brake rod 52 by pushing inwardly on head 50 against the bias of spring 54, the latch plate 62 will be caused to pivot around pin 162, and as shown in FIG. 9, the pointed edge 64 of the latch plate will be disengaged from the lock pin 164. Once the latch plate 62 is unlocked, it is then a simple matter for the operator to rotate the actuating tube 40 clockwise as depicted, arrows A, B, around the longitudinal axis of the forming bar 42 to effect the double seam bending of the prior single seamed roof flanges FL1, FL2. The final step of this operation is as depicted in FIG. 10 of the drawings.

Figure 2A:
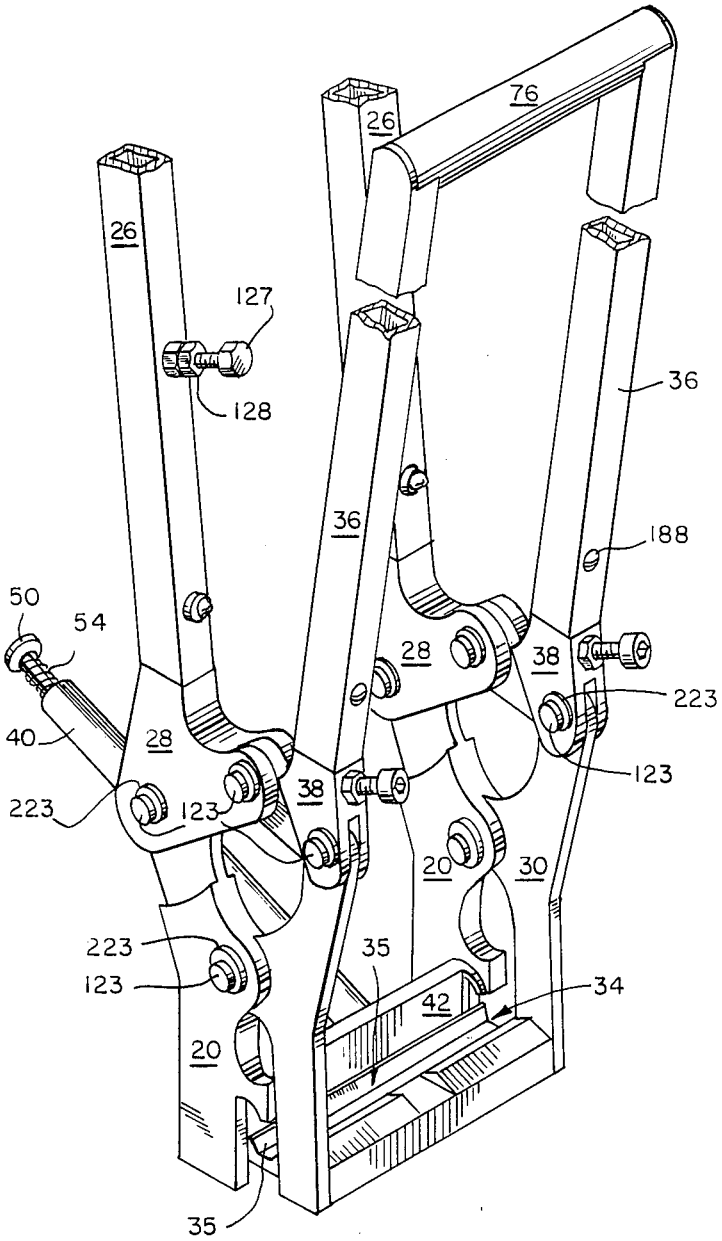
Figure 2B:
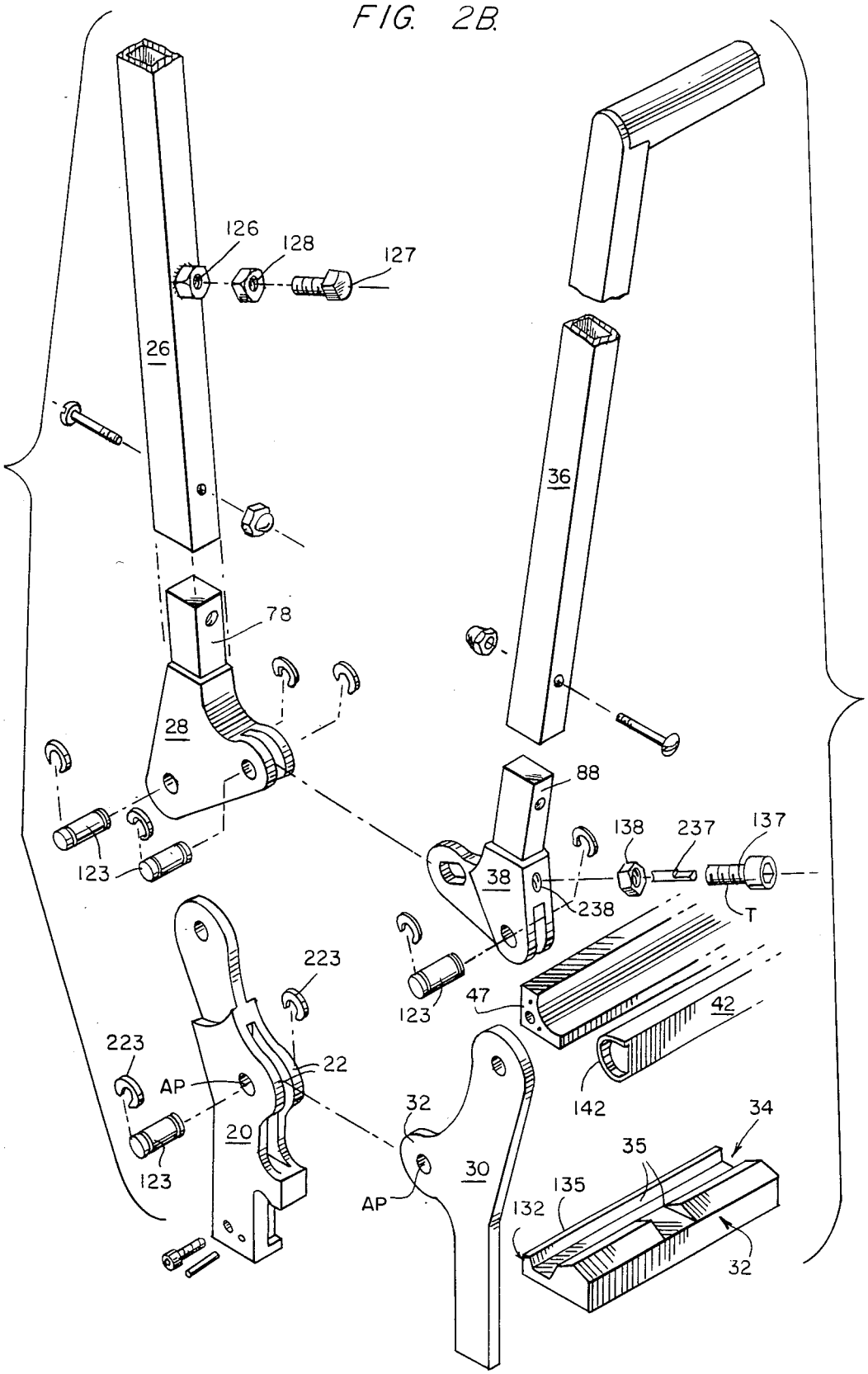
FIG. 2B is an exploded perspective of same.
Figure 3:
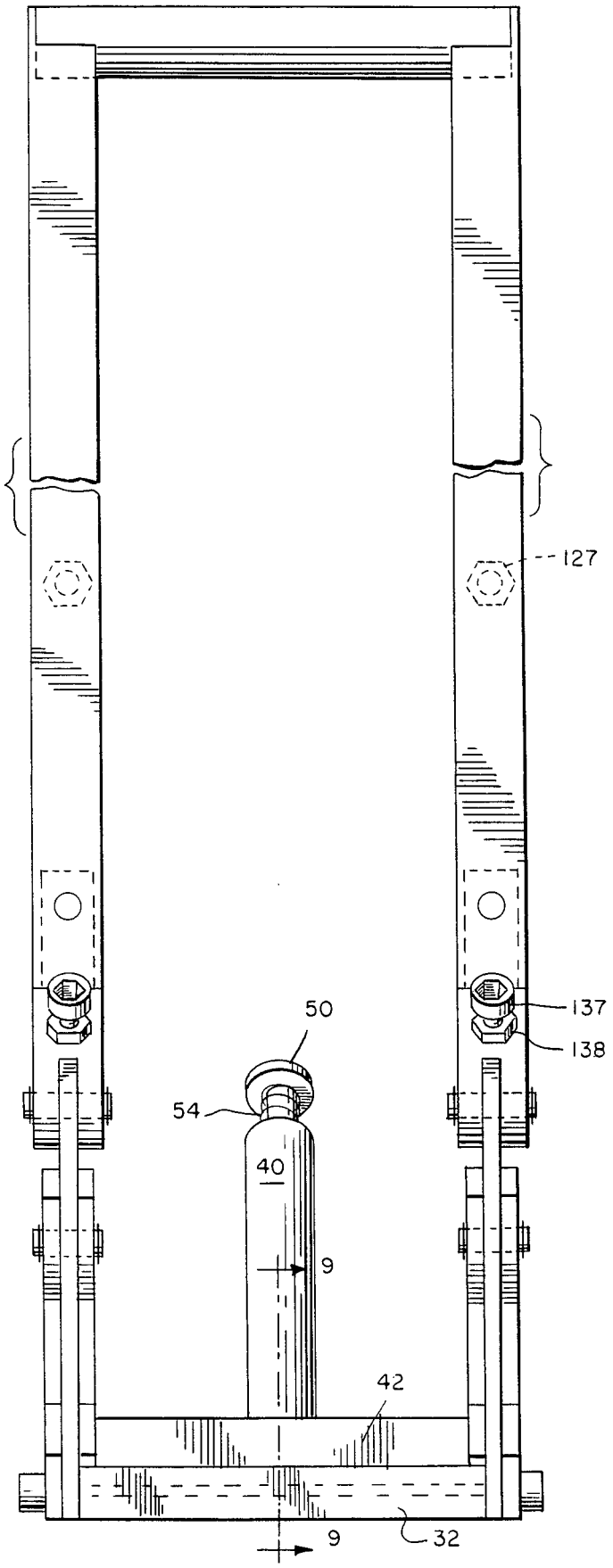
FIG. 3 is a front elevational view of the hand seamer of the present invention.
Figures 4, 7:
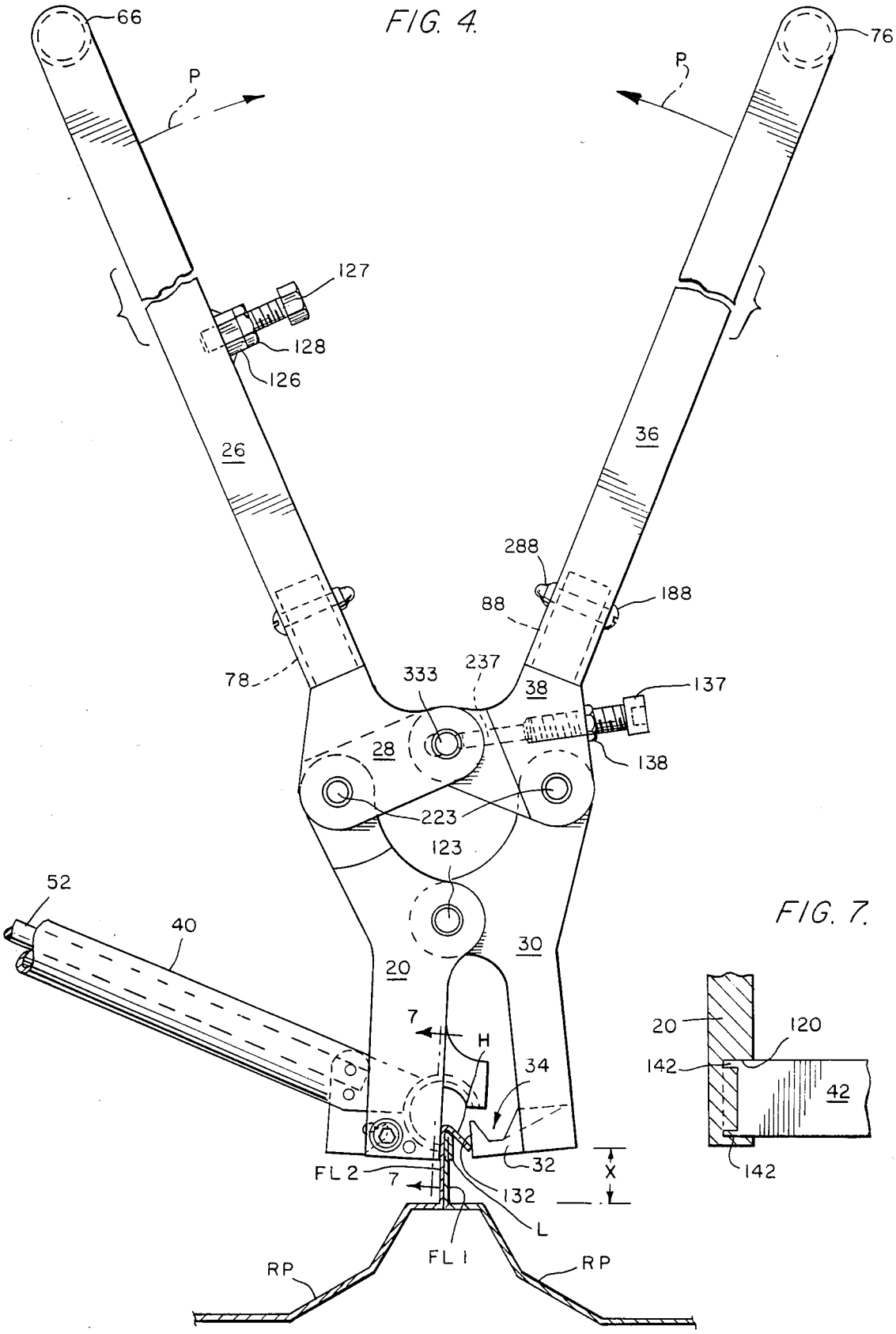
FIG. 4 is a side elevation showing the tool as in use at the very beginning of a seaming operation.
FIG. 7 shows a fragmentary portion of an end of the forming bar.

Looking at FIGS. 2B and 4, the projections 78 and 88 from the actuating members 28 and 38 receive the lower ends of handle tubes 26 and 36, respectively. A pair of handle tubes 26 and a pair 36 are provided, with the other ends thereof ending in traverse cross handles 66 and 76. Also, as shown in the figures, each of the pair of handle elements 26 are provided with nuts 126 welded thereto for receiving adjusting screws 127. The adjusting screws 127 are used to limit the amount of closing between the respective pairs of handles. Locknuts 128 secure the adjustment once made. Similarly, the actuating members 28 and 38 have adjusting screws 137 and locknuts 138 provided therewith. The screws 137 are appropriately threaded T and engage with internal tapped apertures 238 within members 38. The inner end of each screw 137 engages a floating pin 237 which is used between each adjusting screw and the respective pivot pins 123 to permit accurate adjustments to be made. These screws determine the amount of force which can be effected by the anvil head 132 and the forming bar 42 against the respective roof panel seams.

Looking at FIGS. 4–6 and 8–11, the respective steps of the double seam hand-seaming operation will be described. As shown in FIG. 4, two roof panels RP have their respective edges abutting each other. One flange FL1 has a closed lip L provided therewith, while the other flange FL2 has an open hem lip H provided therewith. The two flanges, upon initial installation, are as depicted in this view. Then the hand seamer of this invention is mounted, either at the initial portion of the seam or the final portion of the seam, with a space indicated by X in FIG. 4, so that the anvil head 32 and its face 132 engage with the edge of lip H, while the forming bar 42 and the front lower edges of body elements 20 engage with the backside of the lip H. Upon moving the handles 66 and 76 toward each other, as indicated by arrows P in FIG. 4, the anvil head and forming bar will be brought together. This is step one of the process.

Figure 6:
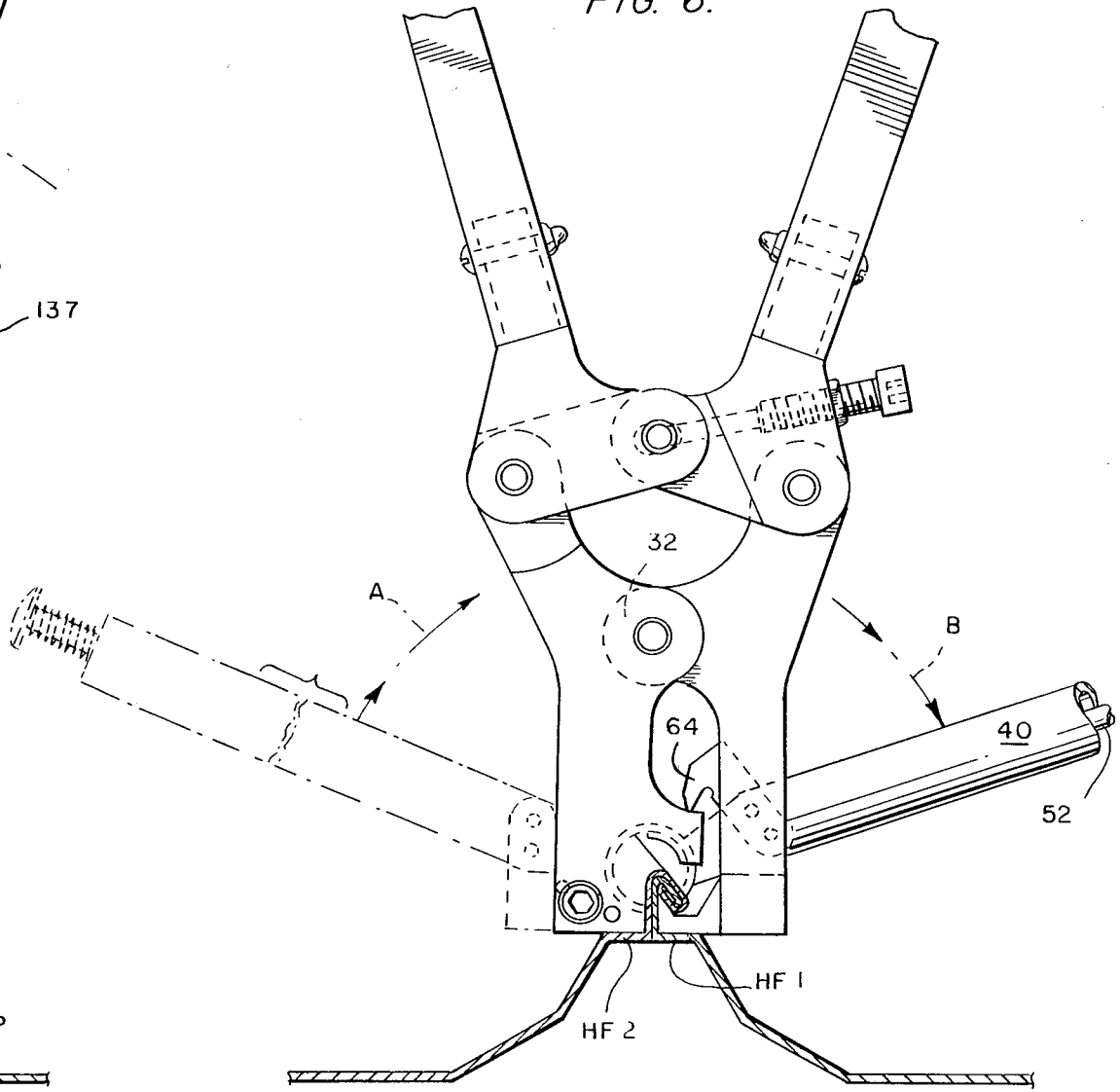
FIG. 6 shows a similar portion of the tool at the end of step 2 of the seaming operation.
Figure 5:
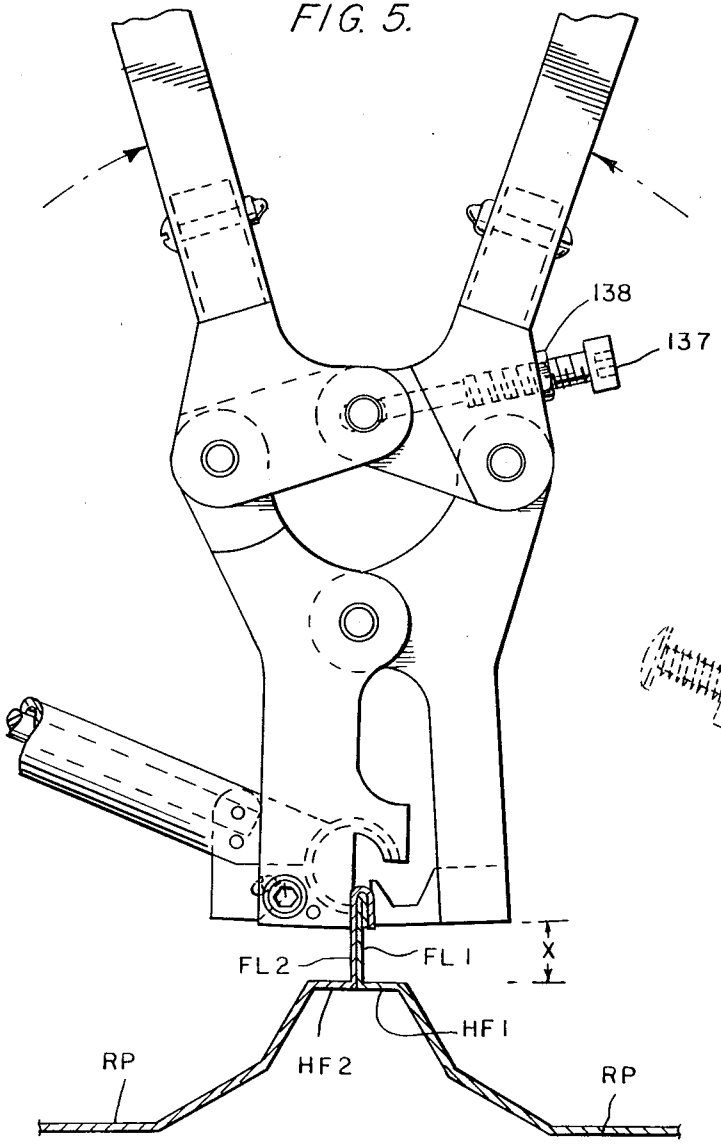
FIG. 5 shows a portion of the tool of FIG. 4 at the end of step 1 of the seaming operation.

FIG. 5 shows the shape of the first seam after completion of step one. The hem H has been completely closed firmly upon the lip L. This view also shows how the adjusting screws 137 function in actual operation. In FIG. 6, which is very similar to FIG. 5, the operation of the actuating bar 40 and the forming bar 42 is depicted. As the forming bar 40 is moved from its initial locked position as indicated by the arrows A to the final form position as indicated by arrows B, the double seaming step takes place.

FIGS. 8–10 show in greater detail and in partial cross section step two of the process. First, the anvil head 32 and the respective main body elements 20 and 30 are rested upon the horizontal flange portions HF1 and HF2, as depicted in FIGS. 6 and 8. Then the brake rod 50 is actuated to release the latch plate 62. As shown in FIG. 9, with the latch plate released, the forming bar 42 can then be rotated about its longitudinal traverse axis so that the upper portion of the first seam of the lips L and H can rotate around the tip portion 135 of the anvil head. As shown in FIG. 10, upon finally reaching this position (also as indicated by the arrows B in FIG. 6), the double seaming operation between adjacent roof panel flanges will be substantially completed.

Figure 11:
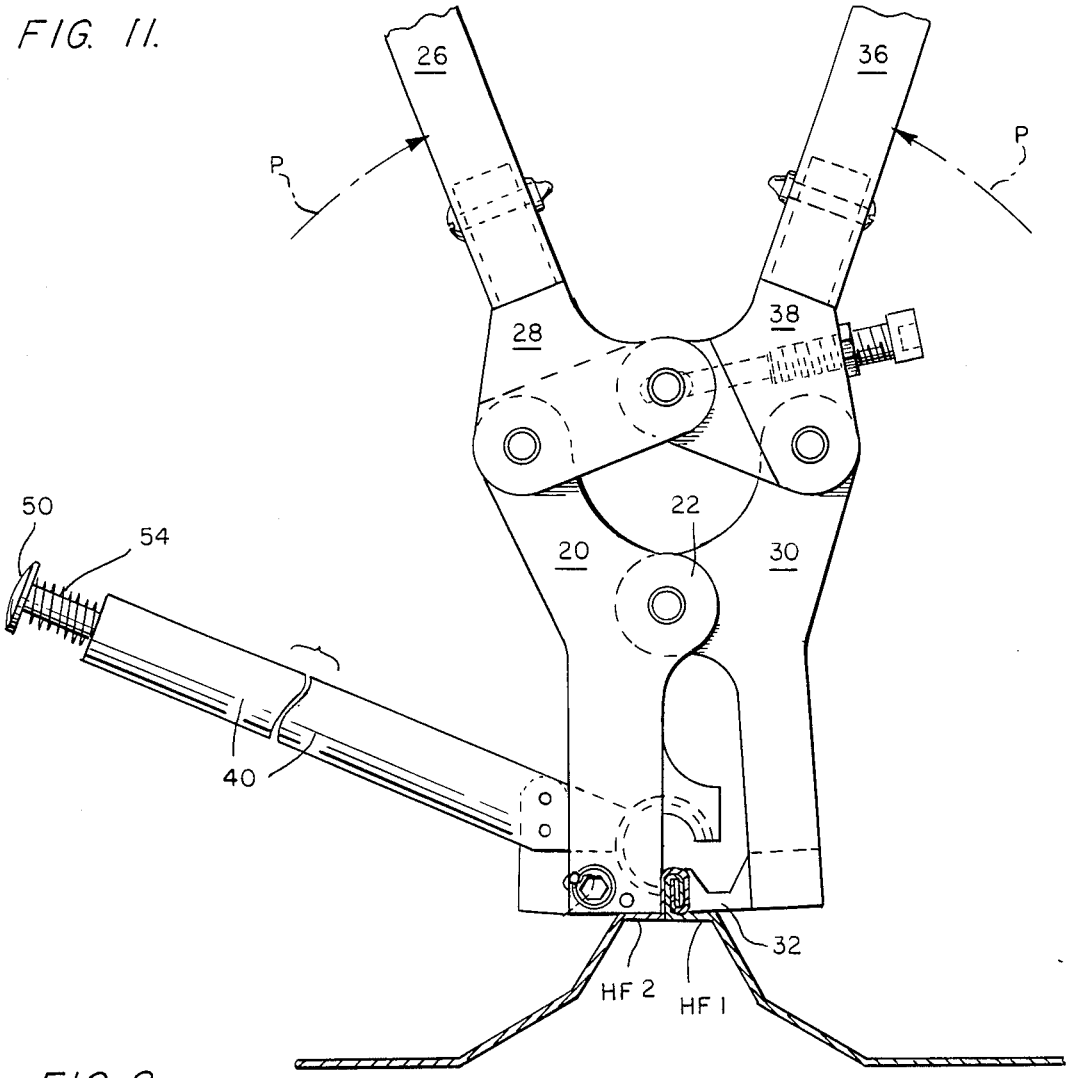
FIG. 11 shows the tool at the completion of step 3 of the seaming operation.

Now looking at FIG. 11, the respective anvil head face 132 of anvil 32 and the forming bar 42 are then used to clamp the double seam to the final completely closed position. Again, the lower portion of the anvil head 32 and the bottom portion of main body elements 20 and forming bar 42 rest upon the horizontal flanges HF1 and HF2, respectively of the adjacent roof panels. The handles 66 and 76 are pushed together, (step three, arrows P) and the double seam is completed.

As shown in FIG. 11, after completion of step three, the double seam operation for the length of the anvil head 32 and forming bar 42 is now completed. Preferably, the widths of these heads is approximately 6", and as shown in FIG. 1, normally three such double seaming operations are performed by hand, thus completing a length of seam of approximately 18". Of course, four steps could be used, making a total length of 24"; however, in actual practice, it has been found that 18" is normally adequate.

Of course, while FIG. 1 only shows the double seaming by hand of one end of the roof panels, as already mentioned, the initial end or both ends of the seaming operation can be done by hand so that the motorized ROOF RUNNER only need be used between these two hand seamed portions. In actual practice, it has been found that the motorized ROOF RUNNER is preferably used to finish the small portion Z of seam between the mid-area and the final hand seamed operation, as shown in FIG. 1, after the hand seaming part has been completed.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed is:

1. A hand seamer tool for use in seaming roof panels together comprising:

a double pair of pivotally interconnected body elements;

actuating members for applying pressure simultaneously on both sides of two roof panel flanges which are abutting each other side-by-side to form a first interlocked seam between said adjacent roof panels;

anvil means mounted on said body elements for directly engaging the roof panel flanges;

limit means for pre-adjusting the amount of force which can be exerted on said anvil means by said actuating members;

forming means for making a further seam of said roof panel flanges after said first seam has been completed by said device;

said means for making a further seam after said first seam has been completed including a traversely extending forming bar mounted on said body elements which can be rotated about its longitudinal axis for performing a double seaming operation by device; and said forming bar having actuating tube means associated therewith, which actuating tube means also is provided with a lock therefor, and wherein said lock comprises a latch plate having a catch projection extending therefrom together with release means with said forming bar for disengaging said latch plate as appropriate.

2. The hand seamer tool of claim 1, wherein said actuating means for applying pressure to said main body elements comprises a double pair of handle members.

3. The hand seamer tool of claim 2, wherein further included is a projection from a first pair of said main body elements which interengage with complementary projections on the second pair of main body elements, and pins interconnecting same to permit pivotal movement thereof.

4. The hand seamer tool of claim 3, wherein the anvil means on said body elements includes a longitudinal anvil head having a flat flange lip engaging face and a flange seam receiving recess along another surface thereof.

5. The hand seamer tool of claim 4, wherein said flange seam receiving recess has a surface which is sloped at an angle to said seam engaging face to provide space for removal of said anvil head from the flange lips after a double seaming operation step has been performed.

6. The hand seamer tool of claim 4, wherein the pre-adjusting limit means for limiting the amount of force which can be exerted includes adjustable means on said actuating means for limiting the degree to which same can be closed.

7. The hand seamer tool of claim 6, wherein said adjustable means includes at least a limit stop, a screw and a locknut therefor.

8. The hand seamer tool of claim 6, wherein said means for making a further seam after said first seam has been completed includes a traversely extending forming bar mounted on said body elements which can be rotated about its longitudinal axis for performing a double seaming operation by the device.

9. The hand seamer tool of claim 1, wherein said forming bar is an anvil-type semi-circular member together with a semi-circular projection extending from each of the respective ends thereof for complementary mating engagement with similar semi-circular recesses provided in two of the body elements.

10. The hand seamer tool of claim 1, wherein said forming bar is an anvil-type semi-circular member together with a semi-circular projection on the respective ends thereof for complementary mating engagement with similar semi-circular recesses provided in the body elements.

11. The hand seamer tool of claim 1, wherein the pre-adjusting limit means for limiting the amount of force which can be exerted includes adjustable means on said actuating members for limiting the degree to which same can be closed.

12. The hand seamer tool of claim 11, wherein said adjustable means includes at least, a limit stop, a screw and locknut therefor.

13. The hand seamer tool of claim 1, wherein the anvil means on said body elements comprises a longitudinal anvil head having a flat flange lip engaging face and a flange seam receiving recess along another surface thereof.

14. The hand seamer tool of claim 13, wherein said flange seam receiving surface is sloped at an angle to said seam engaging face to provide space for removal of said anvil head from the flange lips after a double seaming operation step has been performed.

15. A hand seamer tool for use in seaming roof panels together comprising:

a double pair of pivotally interconnected main body elements;

actuating means for applying pressure simultaneously to said pairs of main body elements on both sides of two roof panel flanges which are abutting each other side-by-side to form a first interlocked seam between said adjacent roof panels;

anvil means mounted on said body elements for directly engaging the roof panel flanges;

limit means for pre-adjusting the amount of force which can be exerted on said anvil means by said actuating means;

forming means for making a further seam of said roof panel flanges after said first seam has been completed by said device;

said actuating means for applying pressure to said main body elements comprising a double pair of handle members;

a projection from a first pair of said main body elements interengaging with complementary projections on the second pair of main body elements and pins interconnecting same to permit pivotal movement thereof;

the anvil means on said body elements including a longitudinal anvil head having a flat flange lip engaging face and a flange seam receiving recess along another surface thereof;

the pre-adjustable limit means for limiting the amounts of force which can be exerted including adjustable means on said actuating means for limiting the degree to which same can be closed;

said means for making a further seam after said first seam has been completed including a traversely extending forming bar mounted on said main body element which can be rotated about its longitudinal axis for performing a double seaming operation by the device;

said forming bar having an actuating tube means associated therewith, which actuating tube means also is provided with a lock therefor; and said lock comprising a latch plate having a catch projection extending thereform together with release means with said forming bar for disengaging said latch as appropriate.

16. A tool device for making double seams during roof panel installation by hand comprising:

a pair of main body elements pivotally mounted with respect to each other;

a pair of actuating members pivotally mounted to respective ones of said first pair and also being pivotally interconnected together;

handle means attached to each of said actuating members for movement of same as appropriate;

adjustable limit structure associated with at least one of the aforesaid structures for limiting the amount of pressure and force which can be exerted thereby;

flange lip engaging means affixed to each of said main body elements for direct engagement with the flanges of respective roof panels;

said flange lip engaging means including a preformed anvil head and a rotatable forming bar opposite thereto; and wherein said rotatable forming bar is provided with lock means for preventing operation thereof until an appropriate time.

17. The tool device of claim 16, wherein said lock means is actuated manually by an operator by releasing brake means associated therewith, whereupon the operator can operate said forming bar to form a double seam forming of the adjacent lip flanges of the respective roof panels.

* * * * *